US006011942A

United States Patent [19]

Taniguchi et al.

[11] Patent Number: 6,011,942

[45] Date of Patent: Jan. 4, 2000

[54] CYLINDRICAL ROTATING MEMBER HAVING A SUPPORT MECHANISM EXHIBITING LITTLE UNEVENNESS IN ROTATION, AND IMAGE FORMING APPARATUS

[75] Inventors: Hajime Taniguchi; Tooru Watanabe; Ikuro Chimoto, all of Toyokawa; Akihiro Nakamura, Osaka; Masato Togami, Toyohashi, all of Japan

[73] Assignee: Minolta Co., Ltd., Osaka, Japan

[21] Appl. No.: 09/084,947

[22] Filed: May 28, 1998

[30] Foreign Application Priority Data

May 29, 1997 [JP] Japan ..... 9-139917

[51] Int. Cl.[7] ..... G03G 21/00

[52] U.S. Cl. ..... 399/167; 464/42; 464/147

[58] Field of Search ..... 399/159, 116, 399/167, 117; 492/47; 82/165, 166; 464/147, 57, 42, 43, 44, 106, 109

[56] References Cited

U.S. PATENT DOCUMENTS

| | | | |
|---|---|---|---|
| 4,345,945 | 8/1982 | Junker | 82/166 |
| 5,019,861 | 5/1991 | Surti | 399/167 X |
| 5,023,660 | 6/1991 | Ebata et al. | 399/167 X |
| 5,309,200 | 5/1994 | Michlin . | |
| 5,420,664 | 5/1995 | Miwa et al. | 399/167 |
| 5,570,160 | 10/1996 | Miwa et al. | 399/116 |
| 5,669,046 | 9/1997 | Yoshida et al. | 399/167 |
| 5,749,028 | 5/1998 | Damji et al. | 399/117 |
| 5,809,380 | 9/1998 | Katakabe et al. | 399/167 |
| 5,878,310 | 3/1999 | Noda et al. | 399/117 |
| 5,895,145 | 4/1999 | Yamada | 399/167 X |

FOREIGN PATENT DOCUMENTS

| | | | |
|---|---|---|---|
| 1-199022 | 8/1989 | Japan | 464/106 |

*Primary Examiner*—Susan S. Y. Lee
*Attorney, Agent, or Firm*—McDermott, Will & Emery

[57] ABSTRACT

It is desirable if the lengthwise center axis of a cylindrical rotating member such as a photoreceptor drum is aligned exactly with the center axes of the support shafts. However, as it is impossible to eliminate manufacturing errors in components, it is unavoidable for there to be a slight angle of intersection between the center axis of the cylindrical rotating member and the center axes of the support shaft. Consequently, the object of the present invention is to provide a support mechanism for the cylindrical rotating member whereby the cylindrical rotating member exhibits little unevenness of rotation. When lengthwise axis of the cylindrical rotating member forms angle of intersection $\alpha$ with lengthwise axis of shaft, this angle $\alpha$ is absorbed by the slight space between shaft and pierced hole of a rotation transmission member, as well as by the gap between the rotation transmission member and bearing of the cylindrical rotating member, so that the center axis of the cylindrical rotating member is fixed in a set position, and the outer circumference of the cylindrical rotating member moves in a predetermined perfectly circular path.

28 Claims, 7 Drawing Sheets

Fig. 6

| | Amount of Pitch Distortion(%) | Amount of Edge Distortion(%) |
|---|---|---|
| First embodiment( $\phi$ 100) | 1.20 | ±0. 9 |
| First embodiment( $\phi$ 80) | 1.04 | ±0. 7 |
| First embodiment( $\phi$ 60) | 0.69 | ±0. 6 |
| Prior art( $\phi$ 100) | 2.56 | ±1. 6 |
| Prior art( $\phi$ 80) | 2.11 | ±1. 4 |
| Prior art( $\phi$ 60) | 1.56 | ±1. 2 |

CYLINDRICAL ROTATING MEMBER HAVING A SUPPORT MECHANISM EXHIBITING LITTLE UNEVENNESS IN ROTATION, AND IMAGE FORMING APPARATUS

This application is based on application No. 9-139917 filed in Japan, the contents of which is hereby incorporated by reference.

BACKGROUND OF THE INVENTION

1. Field of the Invention

The present invention pertains to a mechanism that supports a cylindrical rotating member, e.g., a mechanism that can appropriately be used to rotatably support a photoreceptor drum in an image forming apparatus such as a copying machine based on the electrophotographic method.

2. Description of the Related Art

It is desirable if the lengthwise center axis of the photoreceptor drum mounted in an image forming apparatus such as a copying machine is aligned exactly with the center axes of the support shafts supporting the photoreceptor drum at either end of said drum.

However, as it is impossible to eliminate manufacturing errors in components, including photoreceptors, it is unavoidable for there to be a slight angle of intersection between the center axis of the photoreceptor drum and the center axes of the support shafts. In particular, in a support mechanism in which a shaft is mounted to a member that is located at each end of the photoreceptor, and these shafts are inserted into bearing holes formed in flanges at either end of the photoreceptor, said discrepancy in the alignment of the center axes are so large that the problem arises that they become reflected in the image.

SUMMARY OF THE INVENTION

Consequently, the object of the present invention is to provide an image forming apparatus in which unevenness in the rotation of the cylindrical rotating member can be eliminated to the extent possible.

Another object of the present invention is to provide a cylindrical rotating member that rotates based on the rotational force transmitted from a rotating driven shaft, wherein said cylindrical rotating member exhibits little unevenness, of rotation.

Yet another object of the present invention is to provide a support mechanism for a cylindrical rotating member whereby the cylindrical rotating member exhibits little unevenness of rotation.

In order to attain these objects, a first aspect of the present invention comprises an image forming apparatus having a cylindrical rotating member, a rotating driven shaft, a first rotation transmission member that is fixed to said shaft and rotates together with it, and a second rotation transmission member that engages with said first rotation transmission member and that transmits to the cylindrical rotating member the rotational force of the first rotation transmission member, wherein said second rotation transmission member has a pierced hole formed in it for insertion of the shaft such that there is a gap between it and the shaft when the shaft is inserted.

A second aspect of the present invention comprises a cylindrical rotating member that rotates based on the rotational force transmitted from the shaft via a first rotation transmission member fixed to the rotating driven shaft, wherein said cylindrical rotating member has a second rotation transmission member that engages with said first rotation transmission member and that transmits to the cylindrical rotating member the rotational force of said first rotation transmission member, and wherein said second rotation transmission member has a pierced hole formed in it for insertion of the shaft such that there is a gap between it and the shaft when the shaft is inserted.

A third aspect of the present invention comprises a support mechanism for a cylindrical rotating member having a transmission member that transmits to the cylindrical rotating member the rotational force of the rotating driven shaft, wherein said support mechanism is equipped with a first rotation transmission member that is fixed to said shaft and rotates together with it, as well as a second rotation transmission member that has a hole formed in it for insertion of said shaft, engages with said first rotation transmission member and transmits the rotation of said first rotation transmission member to said cylindrical rotating member, and wherein there is a gap between the shaft insertion hole and the shaft.

In addition to the first through third aspects described above, said cylindrical rotating member has a pair of flanges each equipped with at least one bearing, and said second rotation transmission member is rotatably mounted in each of said bearings.

Further, in addition to the first through third aspects described above, either said image forming apparatus or said cylindrical rotating member has a preventive member that prevents the movement of said second rotation transmission member along the lengthwise directions of the shaft and a force-applying member that applies force to said second rotation transmission member toward said control member.

A fourth aspect of the present invention comprises an image forming apparatus that is equipped with a cylindrical rotating member having a flange, a rotating driven shaft, and a rotation transmission member that is inserted in an insertion hole formed in said flange and transmits to the cylindrical rotating member the rotational force of the shaft, wherein said rotation transmission member is formed such that there is a gap between it and the insertion hole when the rotation transmission member is inserted.

A fifth aspect of the present invention comprises a cylindrical rotating member that rotates due to the drive force transmitted from an external device, wherein said cylindrical rotating member is equipped with a drive transmission member that transmits said external drive force to said cylindrical rotating member and a flange that has at least one insertion hole for insertion of said drive transmission member, and wherein said rotation transmission member is formed such that there is a gap between it and said insertion hole when the rotation transmission member is inserted.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 6 is a table showing the results of measurement of the amounts of pitch distortion and leading-edge misalignment when copying is performed of the original document using a copying machine that employs the support mechanism of the first embodiment and using a copying machine employing a conventional support mechanism.

DESCRIPTION OF THE PREFERRED EMBODIMENT

Figure 1:
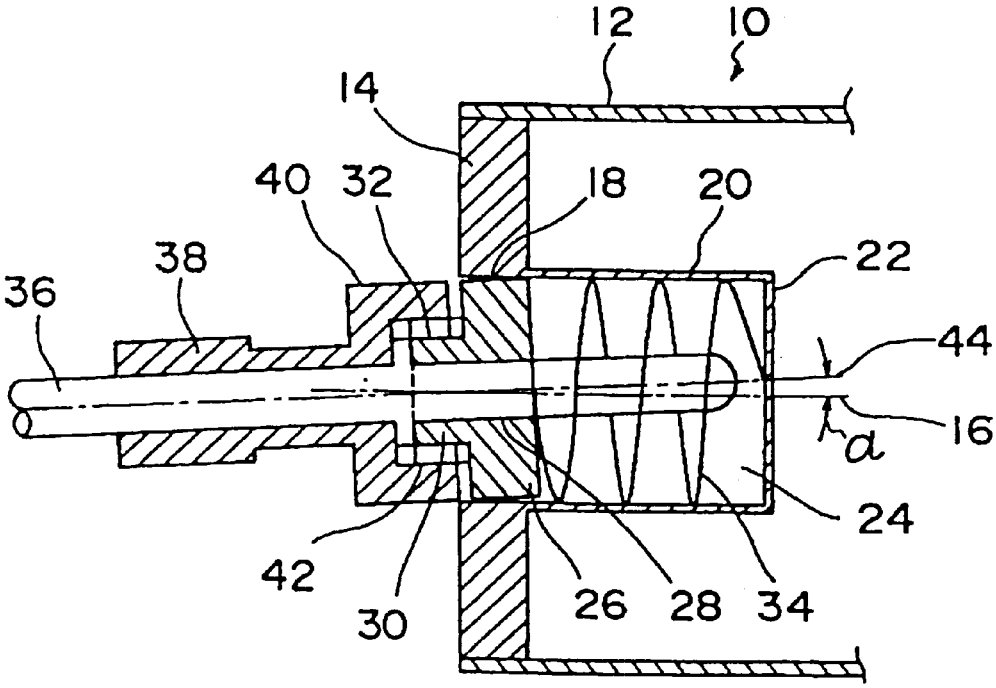
FIG. 1 is a cross-sectional view of a first embodiment of the support mechanism pertaining to the present invention.

Preferred embodiments of the present invention will be explained below with reference to the accompanying drawings. FIG. 1 is an example of the application of the present invention to the support mechanism for photoreceptor 10 of image forming apparatus 1 shown in FIG. 9.

Figure 9:
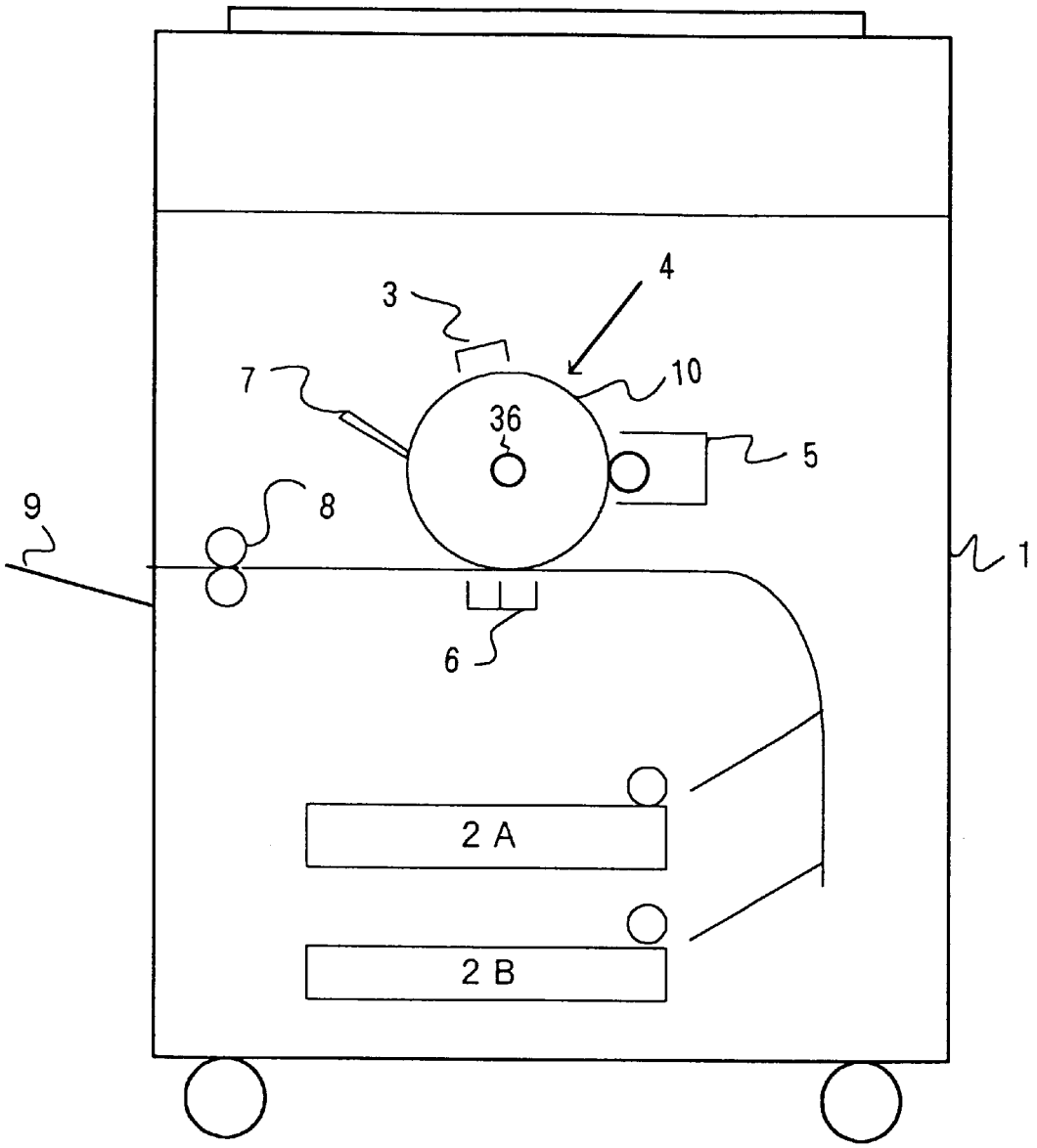
FIG. 9 is a cross-sectional view of an image forming apparatus in which the support mechanism pertaining to the present invention is applied as the photoreceptor support mechanism.

In FIG. 9, photoreceptor 10 is rotatably supported, and rotates based on the rotational drive force transmitted from shafts 36. When this occurs, photoreceptor 10 becomes charged by charging unit 3, and a latent image is formed by means of exposure light 4. The latent image is then developed into a toner image by means of developing unit 5. The toner image on photoreceptor 10 is transferred onto the paper supplied from paper cassettes 2A or 2B by means of transfer unit 6 and fused by means of fuser unit 8, whereupon the paper is ejected onto eject tray 9. The toner remaining on the surface of the photoreceptor after transfer is removed by means of cleaning blade 7.

In FIG. 1, the photoreceptor indicated by the number 10 comprises cylinder 12 having a photoreceptive layer over its outer surface and pair of flanges 14 (one of which is not shown in the drawing) that are fixed to the openings at either end of said cylinder 12. Cylindrical bearing 18 is formed in the flange 14 shown in the drawing using lengthwise axis 16 of photoreceptor 10 as its center axis. Cylindrical wall 20 is formed on bearing 18 such that it extends inside photoreceptor 10 with its outer circumference tracing the same circle as the circumference of bearing 18. The end of cylindrical wall 20 is closed off by end wall 22, and cylindrical space 24 is created inside the structure formed by walls 20 and 22.

Disk-shaped rotation transmission member 26 (the second rotation transmission member, hereinafter termed claw member 26) having a slightly smaller diameter than said bearing 18 is housed inside bearing 18. Claw member 26 has pierced hole 28 in its center, and has cylindrical boss member 30 located on the opposite surface from end wall 22 and aligned with pierced hole 28 at its center. Engaging member (claw) 32 is formed on the outer circumference of boss member 30.

Spring 34 is located in space 24 so as to apply outward force to claw member 26. On the other hand, in order to prevent claw member 26 to which force is applied by means of spring 34 from separating from bearing 18, a member (not shown in the drawing) is formed on the outer end surface of flange 14 to prevent claw member 26 from moving beyond the outer end surface of the flange.

Drive shaft 36 to transmit rotational force to photoreceptor 10 is rotatably fixed at its base end to a base plate not shown in the drawing, such that it transmits rotational force from a drive system not shown in the drawing. Rotation transmission member 38 (the first transmission member, hereinafter termed claw member 38) is fixed to the far end of shaft 36 by means of an appropriate fixing means (e.g., a pin). Claw member 38 has cylindrical protrusion 40 at the tip of the shaft, and engaging member (claw) 42 is formed on the inner circumference of said cylindrical protrusion 40.

The end of the shaft 36 is inserted in pierced hole 28 in claw member 26, and engaging members 32 and 42 of claw members 26 and 38, as shown in the drawing, are engaged with each other. After the rotational force of shaft 36 is transmitted to claw member 38, it is then transmitted to claw member 26 by means of engaging members 32 and 42. Here, because force is applied to claw member 26 toward claw member 38 by means of spring 34, the rotational force is properly transmitted between claw members 26 and 38. Next, the rotational force of claw member 26 is transmitted to flange 14 via the friction between the outer circumference of said claw member 26 and bearing 18 with which it is in contact, and consequently photoreceptor 10 rotates in a prescribed direction. When this occurs, because there is a gap between claw member 26 and bearing 18, the rotational force is transmitted with a slight angle between the rotational axes of claw member 26 and photoreceptor 10.

In the support mechanism for photoreceptor 10 constructed in the manner described above, it is desirable for lengthwise axis 16 of photoreceptor 10 (the axis of rotation) to be aligned exactly with lengthwise axis 44 of shaft 36 supporting it, but in actual practice it is impossible to achieve such an exact alignment, and there is normally a slight angle between lengthwise axis 44 of shaft 36 and lengthwise axis 16 of photoreceptor 10, as shown in the drawing.

This slight angle is absorbed by said gap between claw member 26 and bearing 18. In order to further eliminate the rotational unevenness of photoreceptor 10 caused by said angle, the outer diameter of shaft 36 is made slightly smaller than the diameter of pierced hole 28 formed in claw member 26. For example, where a metal rod having a nominal diameter of 8 mm is used for shaft 36, its outer diameter is made approximately 0.01 mm to 0.05 mm smaller than 8 mm. Conversely, the inner diameter of claw member pierced hole 28 is made approximately 0.02 mm to 0.08 mm larger than 8 mm. Therefore, the gap between shaft 36 and pierced hole 28 ranges from 0.03 mm to 0.13 mm.

As a result, when lengthwise axis 16 of photoreceptor 10 forms angle of intersection a with lengthwise axis 44 of shaft 36, this angle $\alpha$ is absorbed by the slight space between shaft 36 and pierced hole 28 of claw member 26, as well as by the gap between claw member 26 and bearing 18, so that the center axis of photoreceptor 10 is fixed in a set position, and the outer circumference of photoreceptor 10 moves in a predetermined perfectly circular path.

Figure 2:
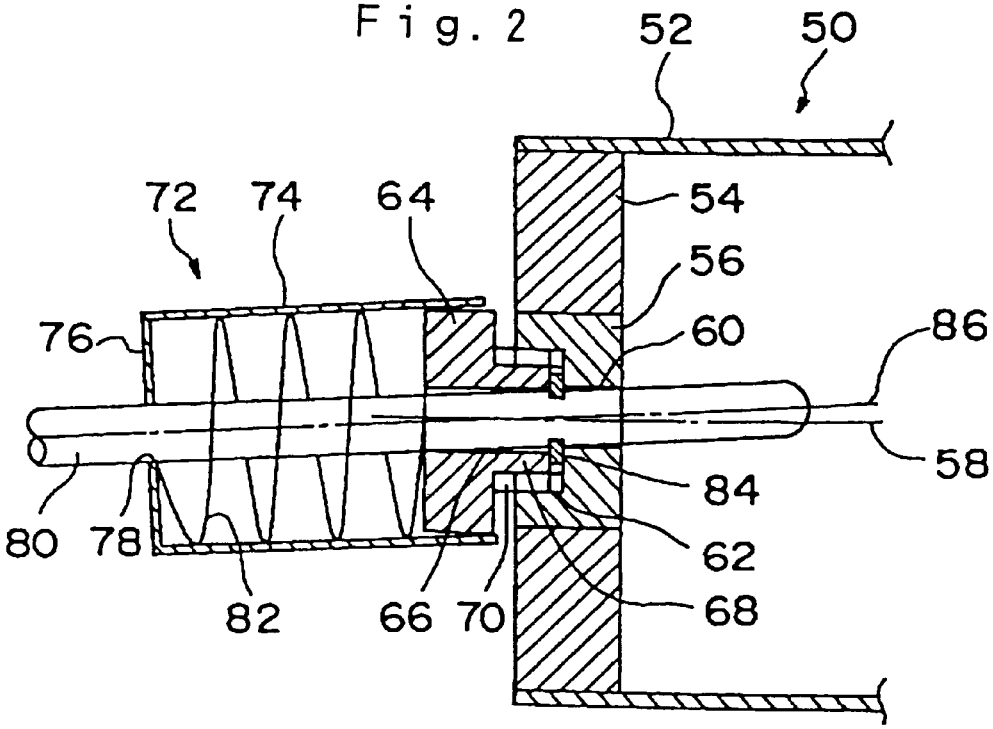
FIG. 2 is a cross-sectional view of a second embodiment of the support mechanism pertaining to the present invention.

FIG. 2 shows a second embodiment of the present invention. In this embodiment, flange 54 that is located at one end of photoreceptor 50 and supports cylinder 52 of photoreceptor 50 has bearing 56. Pierced hole 60 in which the shaft is inserted and engaging member 62 located outside of pierced hole 60 are formed in bearing 56 with their center axes aligned with lengthwise axis 58 of cylinder 52.

Ring-shaped claw member 64 having essentially the same configuration as claw member 26 of the first embodiment is used as the second rotation transmission member. Claw member 64 has pierced hole 66 in its center as well as cylindrical boss member 68 on one end surface, and engaging member 70 is formed around this boss member 68.

Cylindrical member 72 is formed around the second rotation transmission member. Cylindrical member 72 comprises cylinder 74 and ring-shaped flange 76 fixed to the opening at one end of said cylinder 74. Shaft 80 is inserted in pierced hole 78 in the center of ring-shaped flange 76, which is fixed to shaft 80 by means of a fixing means not shown in the drawing. The inner diameter of cylinder 74 is equal to or slightly larger than the outer diameter of claw member 64. In the second embodiment, the first rotation transmission member comprises cylindrical member 72 and ring-shaped flange 76.

This claw member 64 is housed in cylindrical member 72 with shaft 80 inserted in its pierced hole 66. Boss member 68 faces outside cylindrical member 72, i.e., toward the tip of shaft 80. Spring 82 is located inside cylindrical member 72 as shown in the drawing, and applies outward force on claw member 64. Ring 84 is placed on shaft 80, and consequently the movement of claw member 64 from a prescribed position toward the shaft tip is prevented.

The tip of shaft 80 is then inserted into flange pierced hole 60, and engaging member 68 of claw member 64 engages with flange engaging member 62. After the rotational force of shaft 80 is transmitted from cylindrical member 72 to claw member 64 that is in contact with the inner surface of said cylindrical member 72, it is transmitted to flange 54 via engaging members 62 and 68.

As in the first embodiment, the inner diameter of claw member pierced hole 66 is larger than that of the outer diameter of shaft 80 to the same extent as in the first embodiment. Therefore, even where lengthwise axis 58 of photoreceptor 50 forms an angle with lengthwise axis 86 of shaft 80, this misalignment is absorbed by the slight space between shaft 80 and claw member pierced hole 66, so that photoreceptor 50 rotates around lengthwise axis 58 that is perfectly aligned along a predetermined axis.

Figure 3:
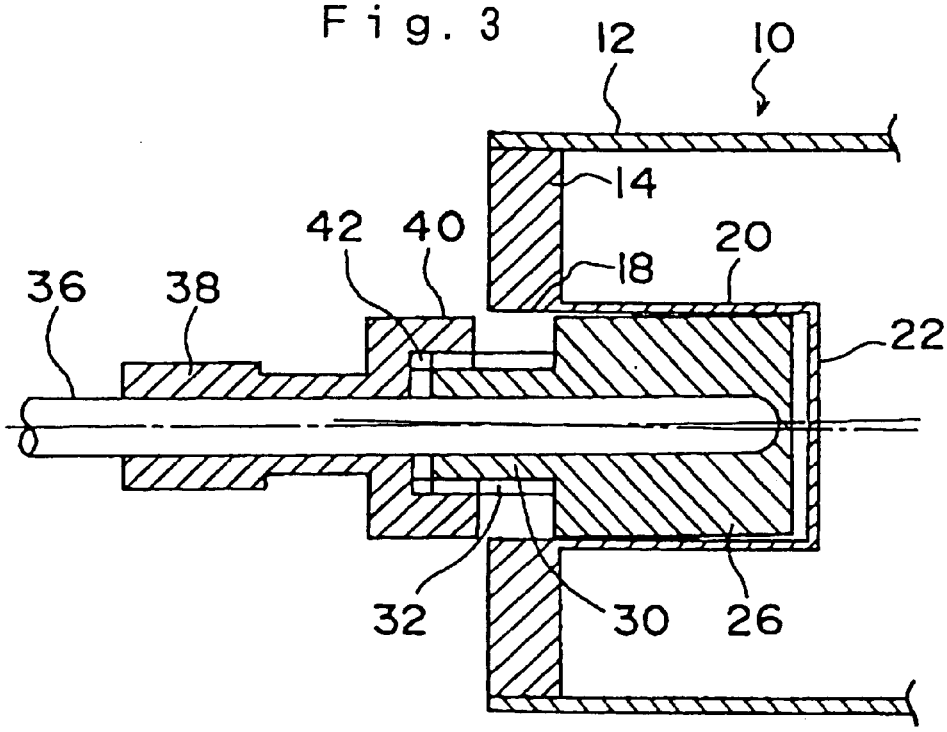
FIG. 3 is a cross-sectional view of a third embodiment of the support mechanism pertaining to the present invention.

FIG. 3 shows a third embodiment of the present invention. This embodiment is a variation of the first embodiment, differing from the first embodiment only in that spring 34 is eliminated and claw member 26 extends to cover the tip of shaft 36, but is essentially identical to the first embodiment in all other respects.

Figure 4:
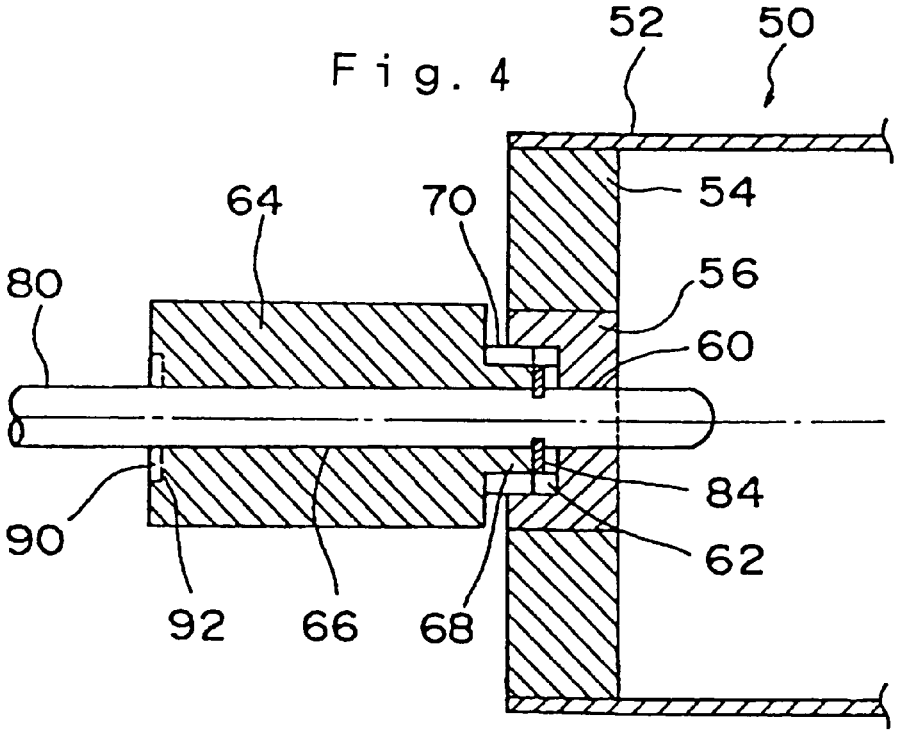
FIG. 4 is a cross-sectional view of a fourth embodiment of the support mechanism pertaining to the present invention.

FIG. 4 shows a fourth embodiment of the present invention. This embodiment is a variation of the second embodiment, wherein cylindrical member 72 and spring 82 are eliminated. In addition, for a first rotation transmission member, instead of cylindrical member 72, pins 90 are fixed to shaft 80. On the other hand, notches 92 are formed in claw member 64 so as to perfectly house pins 90, such that pins 90 engage with these notches 92 and the rotational force of shaft 80 is transmitted to claw member 64.

In the third and fourth embodiments as well, the pierced holes in claw members 26 and 64 have a diameter that is slightly larger than the outer diameter of shafts 36 and 80 that are inserted in these pierced holes, and as a result the photoreceptor rotates around its center axis that is perfectly aligned along a predetermined axis.

In the first and second embodiments, a spring is used as a means to apply force to the claw member, but a different force-applying means (such as a sponge) may be used as long as it can apply force to the claw member.

The present invention is explained above with regard to a situation in which it is applied in a mechanism to support a photoreceptor in an image forming apparatus, but the present invention may also be applied in any device that supports a cylindrical rotating member.

The support mechanism described above may be applied at either one end of the cylindrical body or at both ends of said body.

Figure 5:
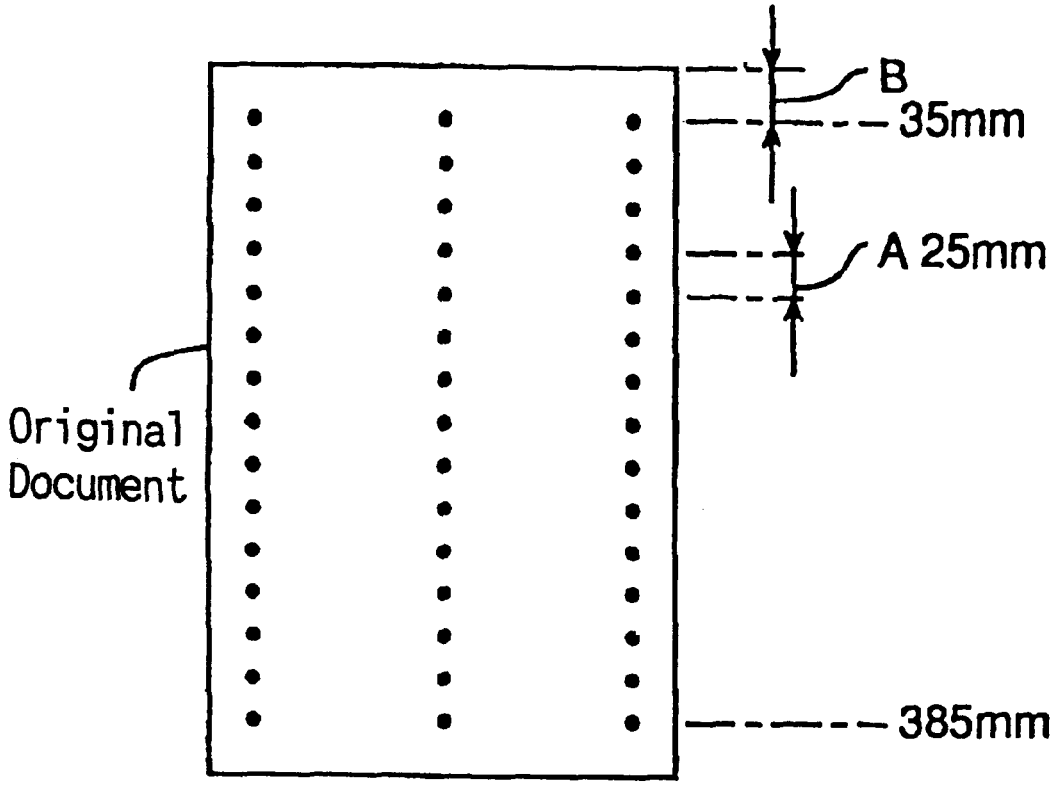
FIG. 5 is a plan view of an original document used in an experiment performed for purposes of evaluation.

Using the photoreceptor supported by means of the support mechanism of the first embodiment, as shown in FIG. 5, an original document (sample image) having dots aligned into columns in the middle and at the edges of the paper and located at a prescribed distance from each other (25 mm) was copied, the dot spacing in the copied image (corresponding to distance A on the document) was measured, and the amount of distortion [100·(distance A in original document image/distance A in copied image)(%)] was sought. In addition, the distance from the leading edge of the copy paper to the first copy dot (corresponding to distance B on the original document) was measured and the amount of blurring [distance B in the original document image−distance B in copied image (mm)] was sought. In the experiment, three types of photoreceptors (100 mm, 80 mm, 60 mm) were used. The spring constant of the spring used was 35 g/mm. For a control, the same photoreceptors were supported by shafts fixed to the copying machine main unit using a conventional support mechanism and the amount of distortion was measured in the same way.

As a result, as shown in the table in FIG. 6, in the images created using photoreceptors supported by any of the support mechanisms pertaining to the present invention, the amounts of pitch distortion and edge distortion were considerably less than those in the images created using photoreceptors supported by the conventional fixed-type support mechanism (the control units).

Figure 7:
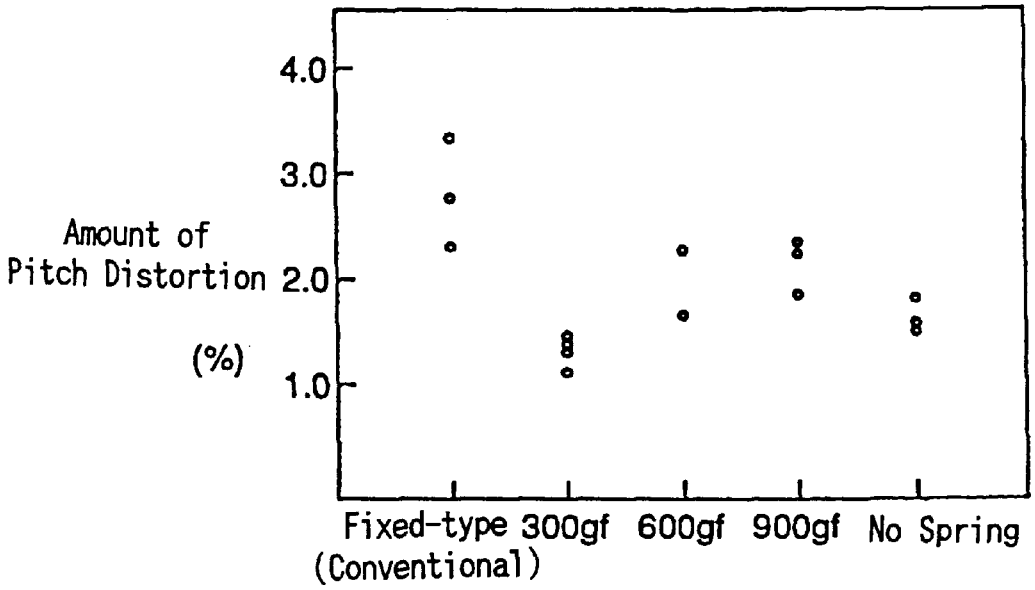
FIG. 7 is a graph showing the amount of pitch distortion when the amount of spring force in the support mechanism of the first embodiment is changed, the amount of pitch distortion using the support mechanism of the third embodiment in which there is no spring, and the amount of pitch distortion using the conventional support mechanism.

Next, the spring force of the spring in the support mechanism of the embodiment shown in FIG. 1 containing a spring was changed and the amount of pitch distortion was measured. The amount of pitch distortion was also measured using the support mechanism of the embodiment shown in FIG. 3 in which the spring is eliminated. For a control, the amount of pitch distortion was measured using the conventional fixed-type support mechanism. As a result, the desirable setting for the spring force of the spring was determined to be 300 gf, as shown in FIG. 7. Even where there was no spring, the amount of pitch distortion was reduced to the same extent as when there was a spring. However, it was confirmed that the amount of pitch distortion was larger with the conventional fixed-type support mechanism than with the support mechanisms pertaining to the present invention.

Figure 8A:
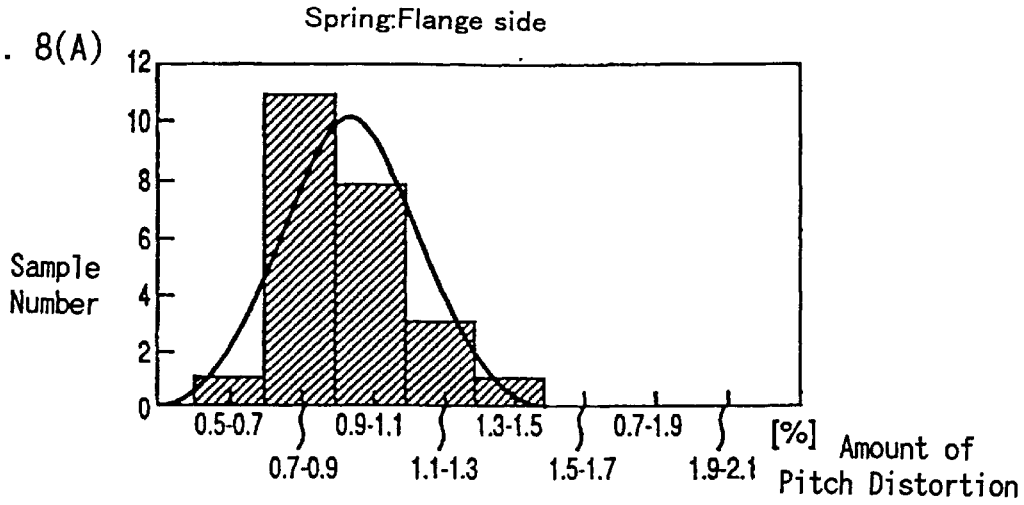
FIGS. 8A through 8C are graphs showing the amount of pitch distortion in the first embodiment in which a spring is mounted to the photoreceptor flange, in the second embodiment in which springs are mounted to the copying machine main unit, and in the conventional fixed-type support mechanism.
Figure 8B:
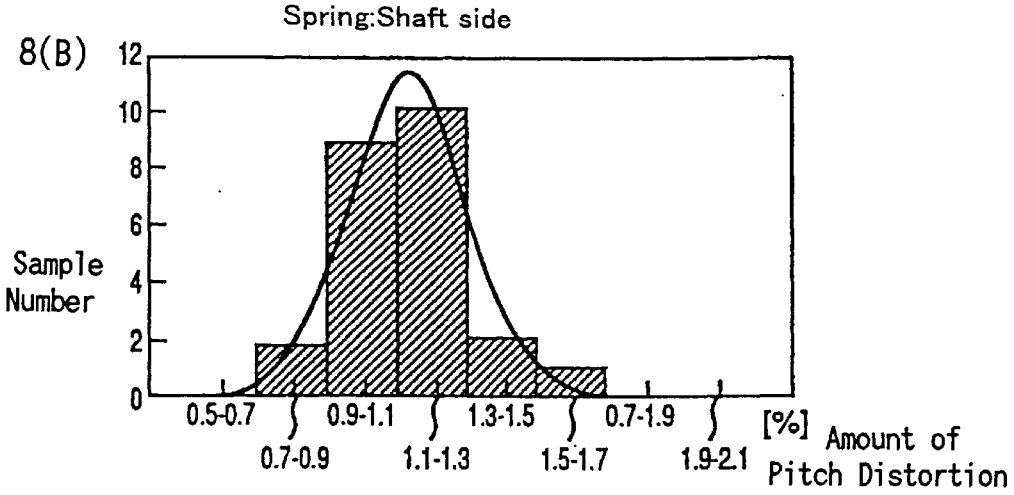
Figure 8C:
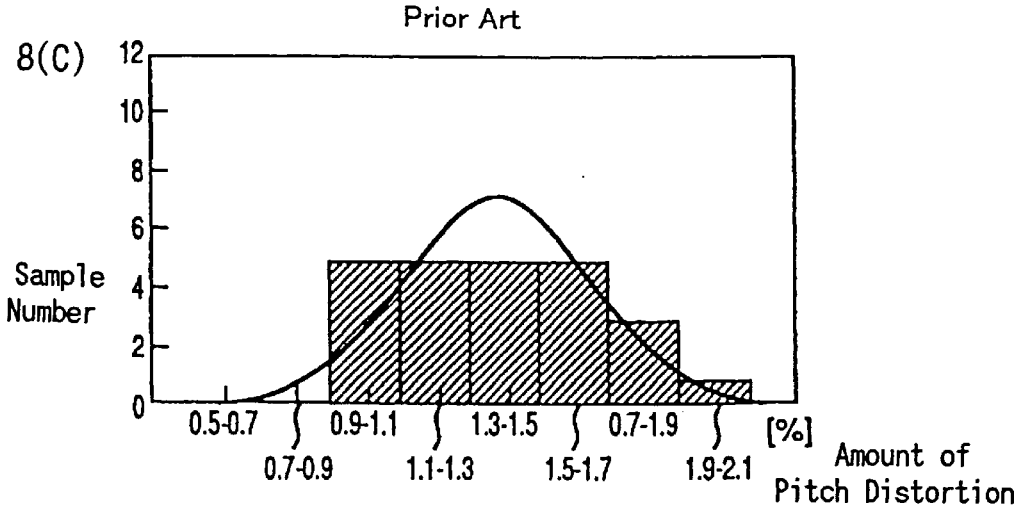

Next, a prescribed number of copies were made of the original document using the support mechanism of the first embodiment, the support mechanism of the second embodiment, and the conventional fixed-type support mechanism, and the distribution of pitch distortion amounts was examined. As shown in FIG. 8(A), FIG. 8(B), FIG.

8(C), it was consequently determined that the pitch distortion using the support mechanism in which a spring is located on the photoreceptor flange side was the smallest and that the pitch distortion using the support mechanism in which a spring is located on the shaft side was the next smallest, while the pitch distortion using the conventional fixed-type support mechanism was the largest.

Using the support mechanisms described above, where the center axis of the shaft is not aligned exactly with the center axis of the rotating member, since the pierced hole into which the shaft is inserted of the second rotation transmission member of said support mechanism is slightly larger than the shaft, this misalignment is absorbed by the space between said pierced hole and the shaft, and as a result the center axis of the rotating member is corrected to be in the position where it should be, and the rotating member can be rotated without unevenness.

Further, the second rotation transmission member may be used either in the photoreceptor bearing or around the shaft. It is also desirable for the support mechanism of the present invention to include a control member that controls the movement of the second rotation transmission member located around the shaft such that it extends along its length and an elastic means that applies force to the second rotation transmission member toward the control member.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

a cylindrical rotatable member;

a rotatable drive shaft;

a first rotation transmission member which is fixed to said rotatable drive shaft for rotating together with said rotatable drive shaft; and a second rotation transmission member which engages said first rotation transmission member for transmitting to the cylindrical rotatable member a rotational force of the first rotation transmission member, wherein said second rotation transmission member has a pierced hole, and wherein a portion of said rotatable drive shaft is located in said pierced hole with a gap between said pierced hole and said rotatable drive shaft.

2. The image forming apparatus as claimed in claim 1, wherein said cylindrical rotatable member has a pair of flanges equipped with at least one bearing, and said second rotation transmission member is rotatably mounted in said bearing.

3. The image forming apparatus as claimed in claim 1, further comprising:

a preventive member which prevents the movement of said second rotation transmission member along a lengthwise direction of the rotatable drive shaft; and a force-applying member which applies force to said second rotation transmission member toward said preventive member.

4. The image forming apparatus as claimed in claim 1, wherein said second rotation transmission member is rotatably mounted on said rotatable drive shaft.

5. The image forming apparatus as claimed in claim 1, wherein said gap is 0.03 mm~0.13 mm.

6. The image forming apparatus as claimed in claim 1, wherein said cylindrical rotatable member is a photoreceptor drum.

7. A cylindrical rotatable member that rotates based on a rotational force transmitted from a rotatable drive shaft via a first rotation transmission member fixed to the rotatable drive shaft, comprising:

a second rotation transmission member which engages said first rotation transmission member for transmitting to the cylindrical rotatable member the rotational force of said first rotation transmission member, wherein said second rotation transmission member has a pierced hole, and wherein a portion of said rotatable drive shaft is located in said pierced hole with a gap between said pierced hole and said rotatable drive shaft.

8. The cylindrical rotatable member as claimed in claim 7, which includes a pair of flanges equipped with at least one bearing, wherein said second rotation transmission member is rotatably mounted in said bearing.

9. The cylindrical rotatable member as claimed in claim 7, further comprising:

a preventive member which prevents the movement of said second rotation transmission member along a lengthwise direction of the rotatable drive shaft; and a force-applying member which applies force to said second rotation transmission member toward said preventive member.

10. The cylindrical rotatable member as claimed in claim 7, wherein said gap is 0.03 mm~0.13 mm.

11. The cylindrical rotatable member as claimed in claim 7, which is a photoreceptor drum for an image forming apparatus.

12. A support mechanism for a cylindrical rotatable member having a transmission member that transmits to the cylindrical rotatable member a rotational force of a rotatable drive shaft, said transmission member including:

a first rotation transmission member which is fixed to said rotatable drive shaft for rotating together with said rotatable drive shaft; and a second rotation transmission member which has a hole for insertion of said rotatable drive shaft therein for engaging with said first rotation transmission member and transmitting the rotation force of said first rotation transmission member to said cylindrical rotatable member, wherein there is a gap between the shaft insertion hole and the shaft.

13. The support mechanism as claimed in claim 12, wherein said cylindrical rotatable member has a pair of flanges equipped with at least one bearing, and said second rotation transmission member is rotatably mounted in said bearing.

14. The support mechanism as claimed in claim 12, further comprising:

a preventive member which prevents the movement of said second rotation transmission member along a lengthwise direction of the rotatable drive shaft; and a force-applying member which applies force to said second rotation transmission member toward said preventive member.

15. The support mechanism as claimed in claim 12, wherein said second rotation transmission member is rotatably mounted on said rotatable drive shaft.

16. The support mechanism as claimed in claim 12, wherein said gap is 0.03 mm~0.13 mm.

17. The support mechanism as claimed in claim 12, wherein said cylindrical rotatable member is a photoreceptor drum for an image forming apparatus.

18. An image forming apparatus comprising:

a cylindrical rotatable member having a flange;

a rotatable drive shaft; and a rotation transmission member which is inserted in an insertion hole formed in said flange for transmitting to the cylindrical rotatable member a rotational force of the rotatable drive shaft, wherein said rotation transmission member is formed such that there is a gap between said rotation transmission member and the insertion hole when the rotation transmission member is inserted.

19. The image forming apparatus as claimed in claim 18, wherein said rotation transmission member includes:

a first rotation transmission member which is fixed to said rotatable drive shaft for rotating together with said rotatable drive shaft; and a second rotation transmission member which is inserted in said insertion hole for engaging with said first rotation transmission member for transmitting the rotation of said first rotation transmission member to said cylindrical rotatable member.

20. The image forming apparatus as claimed in claim 19, wherein said second rotation transmission member has a pierced hole, and wherein a portion of said rotatable drive shaft is located in said pierced hole with a gap between said pierced hole and said rotatable drive shaft.

21. The image forming apparatus as claimed in claim 19, further comprising:

a preventive member which prevents the movement of said second rotation transmission member along a lengthwise direction of the rotatable drive shaft; and a force-applying member which applies force to said second rotation transmission member toward said preventive member.

22. The image forming apparatus as claimed in claim 18, wherein said cylindrical rotatable member is a photoreceptor drum.

23. A cylindrical rotatable member that rotates due to a drive force transmitted from an external device, comprising:

a drive transmission member which transmits said external drive force to said cylindrical rotatable member; and a flange which has at least one insertion hole for insertion of said drive transmission member, wherein said drive transmission member is formed such that there is a gap between it and said insertion hole when the drive transmission member is inserted.

24. The cylindrical rotatable member as claimed in claim 23, wherein said drive transmission member includes:

a first rotation transmission member which is fixed to a rotatable drive shaft for rotating together with said rotatable drive shaft; and a second rotation transmission member which is inserted in said insertion hole for engaging with said first rotation transmission member for transmitting the rotation of said first rotation transmission member to said cylindrical rotatable member.

25. The cylindrical rotatable member as claimed in claim 24, wherein said second rotation transmission member has a pierced hole, and wherein a portion of said rotatable drive shaft is located in said pierced hole with a gap between said pierced hole and said rotatable drive shaft.

26. The cylindrical rotatable member as claimed in claim 24, further comprising:

a preventive member which prevents the movement of said second rotation transmission member along a lengthwise direction of the rotatable drive shaft; and a force-applying member which applies force to said second rotation transmission member toward said preventive member.

27. The cylindrical rotatable member as claimed in claim 23, which is a photoreceptor drum for an image forming apparatus.

28. An image forming apparatus comprising:

a cylindrical rotatable member;

a rotatable drive shaft;

a first rotation transmission member which is fixed to said rotatable drive shaft for rotating together with said rotatable drive shaft;

a second rotation transmission member which is in contact with said first rotation transmission member and rotates with the first rotation transmission member; and a third rotation transmission member which engages said second rotation transmission member for transmitting to the cylindrical rotatable member a rotational force of the second rotation transmission member, wherein said second rotation transmission member has a pierced hole, and wherein a portion of said rotatable drive shaft is located in said pierced hole with a gap between said pierced hole and said rotatable drive shaft.

* * * * *